US008237590B2

(12) United States Patent
Mihai et al.

(10) Patent No.: US 8,237,590 B2
(45) Date of Patent: Aug. 7, 2012

(54) APPARATUS AND METHOD FOR REDUCING FAILURES IN TRAFFIC SIGNALS

(75) Inventors: Dan Mihai, Pointe-Claire (CA); Michel Doss, Montreal (CA); Mohamed Ghanem, Pierrefonds (CA)

(73) Assignee: GE Lighting Solutions, LLC, Cleveland, OH (US)

( * ) Notice: Subject to any disclaimer, the term of this patent is extended or adjusted under 35 U.S.C. 154(b) by 1072 days.

(21) Appl. No.: 12/110,565

(22) Filed: Apr. 28, 2008

(65) Prior Publication Data

US 2009/0267796 A1 Oct. 29, 2009

(51) Int. Cl.
*G08G 1/097* (2006.01)

(52) U.S. Cl. ..... 340/931; 340/907; 340/909; 340/915; 340/916; 340/635

(58) Field of Classification Search ..... 340/906–919, 340/924–931, 635
See application file for complete search history.

(56) References Cited

U.S. PATENT DOCUMENTS

| | | | | |
|---|---|---|---|---|
| 3,336,574 | A * | 8/1967 | Selzer | 340/931 |
| 4,680,537 | A * | 7/1987 | Miller | 324/500 |
| 4,965,556 | A * | 10/1990 | Brodecki et al. | 340/628 |
| 5,121,101 | A * | 6/1992 | Jakubowski et al. | 340/515 |
| 5,387,909 | A * | 2/1995 | Neel et al. | 340/931 |
| 5,663,719 | A * | 9/1997 | Deese et al. | 340/912 |
| 5,874,895 | A * | 2/1999 | Devarney | 340/514 |
| 6,133,854 | A * | 10/2000 | Yee et al. | 340/907 |
| 6,150,771 | A * | 11/2000 | Perry | 315/291 |
| 6,184,799 | B1 * | 2/2001 | Jinno et al. | 340/907 |
| 6,392,563 | B1 * | 5/2002 | Paquette et al. | 340/907 |
| 6,509,840 | B2 | 1/2003 | Martineau | |
| 6,577,247 | B2 * | 6/2003 | Giacaman | 340/907 |
| 6,583,731 | B2 * | 6/2003 | Chan et al. | 340/931 |
| 6,717,526 | B2 | 4/2004 | Martineau et al. | |
| 6,762,563 | B2 * | 7/2004 | St-Germain et al. | 315/129 |
| 7,057,529 | B2 | 6/2006 | Bourgault | |
| 7,391,335 | B2 * | 6/2008 | Mubaslat et al. | 340/657 |
| 7,557,524 | B2 * | 7/2009 | Chevalier et al. | 315/318 |
| 7,586,421 | B2 * | 9/2009 | Witte et al. | 340/908 |
| 7,635,957 | B2 * | 12/2009 | Tripathi et al. | 315/309 |
| 7,864,071 | B2 * | 1/2011 | Bachelder et al. | 340/906 |
| 7,948,398 | B2 * | 5/2011 | Miller | 340/907 |
| 2002/0027510 | A1 * | 3/2002 | Jones et al. | 340/907 |
| 2003/0085710 | A1 | 5/2003 | Bourgault et al. | |
| 2003/0185005 | A1 | 10/2003 | Sommers et al. | |
| 2004/0130453 | A1 * | 7/2004 | Zinn | 340/636.1 |
| 2004/0212309 | A1 | 10/2004 | St.-Germain | |
| 2005/0128768 | A1 | 6/2005 | Martineau | |

(Continued)

FOREIGN PATENT DOCUMENTS

EP 0 172 454 B1 3/1989

(Continued)

*Primary Examiner* — Daniel Wu
*Assistant Examiner* — Son M Tang
(74) *Attorney, Agent, or Firm* — Fay Sharpe LLP

(57) ABSTRACT

An apparatus and method for testing an independent monitoring circuit in an LED traffic signal is provided. The apparatus comprises: a proof test circuit embedded within the traffic signal; and a proof test device embedded within the traffic signal. The method comprises: via the proof test circuit, simulating a faulty traffic signal state; activating the independent monitoring circuit without switching the traffic signal into a high impedance state; energizing the proof test device; and via the proof test device, communicating externally the current state of the independent monitoring circuit.

19 Claims, 7 Drawing Sheets

U.S. PATENT DOCUMENTS

| | | | |
|---|---|---|---|
| 2006/0197684 | A1 | 9/2006 | Tremblay |

FOREIGN PATENT DOCUMENTS

| | | | |
|---|---|---|---|
| EP | 0 955 619 | A1 | 11/1999 |
| EP | 0 786 752 | B1 | 1/2003 |
| EP | 1 286 321 | A1 | 2/2003 |
| EP | 1 261 956 | B1 | 10/2004 |
| EP | 0974 947 | B1 | 12/2004 |
| GB | 2 329 011 | | 3/1999 |
| GB | 2 341 739 | | 3/2000 |
| WO | WO 01/01385 | A1 | 1/2001 |
| WO | WO 01/54095 | A2 | 7/2001 |
| WO | WO 02/15145 | A2 | 2/2002 |
| WO | WO 2005/038476 | A1 | 4/2005 |

* cited by examiner

APPARATUS AND METHOD FOR REDUCING FAILURES IN TRAFFIC SIGNALS

BACKGROUND

The exemplary embodiments disclosed herein relate generally to traffic signals, and, more specifically, they relate to light emitting diode traffic signals.

The basic technology relating to light emitting diode (LED) traffic signals is well established and such traffic signals are in use worldwide. LED traffic signals present numerous advantages over common incandescent lamp traffic signals. Use of LEDs provides a power consumption savings and extremely long life in comparison to common incandescent light sources. The long life span creates improved reliability and sharply lowered maintenance costs.

LED signals have an extremely long service life that has increased with each new generation of LEDs. Incandescent lamps, while having a much shorter service life, have relatively constant light output until a total failure occurs, i.e., burnout of the light filament. LED signals, over an extended period, have gradually diminishing light output. Further, LED light output is negatively affected by temperature. In extreme climate or during unnaturally warm periods LED light output diminishes during the day and then returns to a normal level during cooler periods at night.

Thus, while LED traffic signal technology offers high reliability and low power consumption, it introduces complexity to the overall road traffic control system. Two of the most important issues that need to be addressed are interfacing and monitoring.

Thus, under the current standards, a signal state endangering traffic due to a "single failure" shall be prevented. If the first "single failure" is not apparent, the occurrence of an additional independent "single failure" shall be considered. A signal state endangering traffic due to the combination of both failures shall be prevented. If the first failure is detected by a manual proof test or an on-line test, the detection shall occur within the test proof interval specified by the manufacturer and the probability of a second failure which could cause an unsafe condition within this interval shall be less than $10^{-5}$ per year.

A "single failure" refers to any individual component failure. An "unsafe condition" refers, for example, to a situation where the traffic signal does not generate light when energized and the traffic controller does not detect the failure.

Presently, traffic controllers generally monitor the traffic signal input current to detect a failure. It is assumed that the measured input current always represents the output light. The traffic signal is equipped with an independent monitoring circuit that checks the light output and sets the traffic signal in high impedance state in case of a failure. However, if the traffic signal independent monitoring circuit becomes defective due to a faulty component, the traffic signal may continue to operate and the failure in the monitoring circuit is not apparent to the traffic controller and is not detected. In that situation, a subsequent traffic signal failure that can endanger the public is now possible because the independent monitoring circuit is defective or disabled.

The present invention contemplates a new and improved apparatus and method that resolves the above-referenced difficulties and others.

BRIEF DESCRIPTION

In one aspect of the invention an apparatus for testing an independent monitoring circuit in an LED traffic signal is provided. The apparatus comprises: a proof test circuit embedded within the traffic signal; and a proof test device embedded within the traffic signal.

In another aspect of the invention a method of testing an independent monitoring circuit in a LED traffic signal is provided. The method comprises: via a proof test circuit embedded in the traffic signal, simulating a faulty traffic signal state; activating the independent monitoring circuit without switching the traffic signal into a high impedance state; energizing a proof test device; and via the proof test device, communicating externally the current state of the independent monitoring circuit.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention exists in the construction, arrangement, and combination of the various parts of the apparatus, and steps of the method, whereby the objects contemplated are attained as hereinafter more fully set forth, specifically pointed out in the claims, and illustrated in the accompanying drawings in which:

DETAILED DESCRIPTION

Figure 1A:
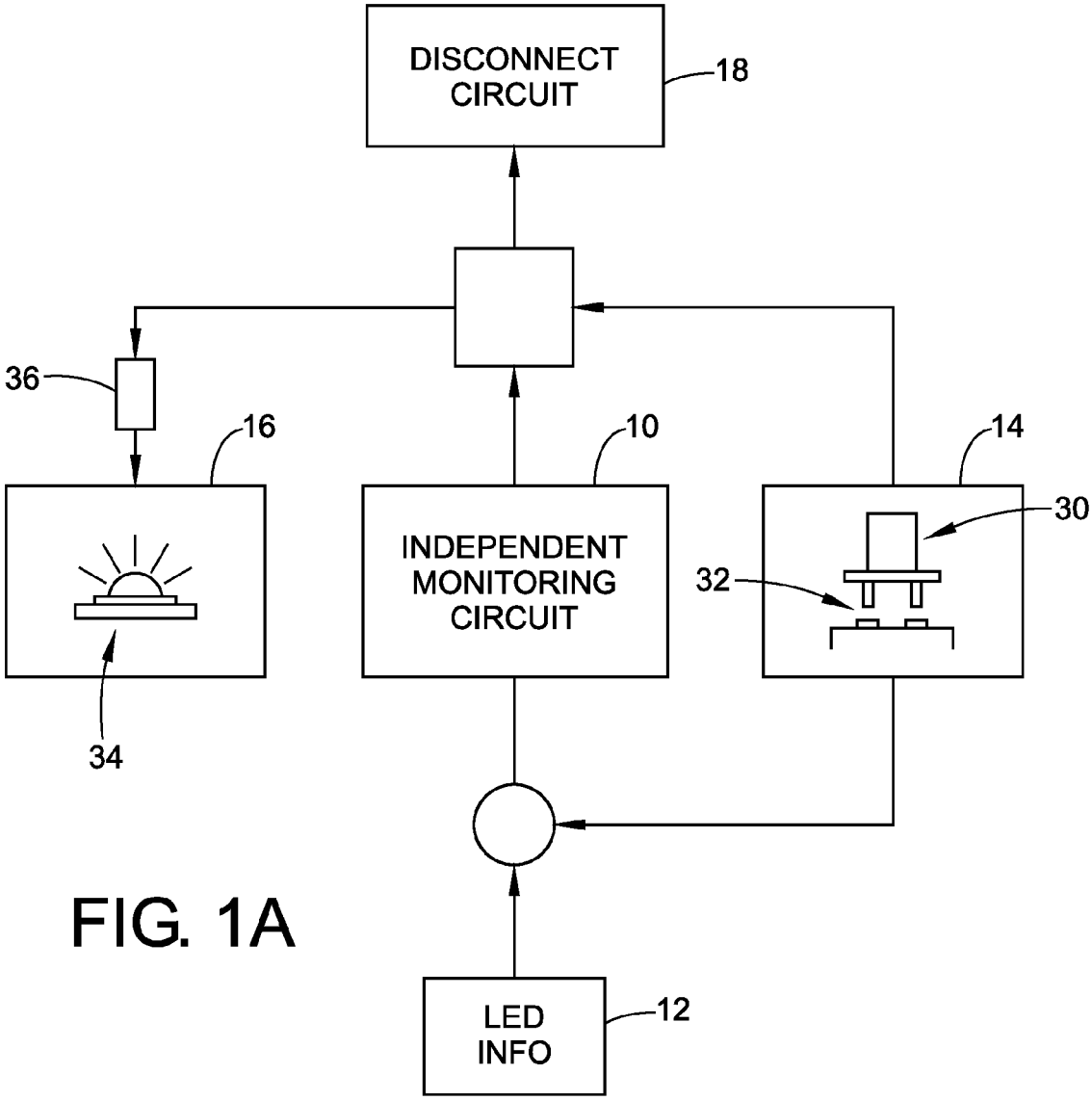
FIG. 1 is a block diagram of a system into which the exemplary embodiments may be incorporated.
Figure 1B:
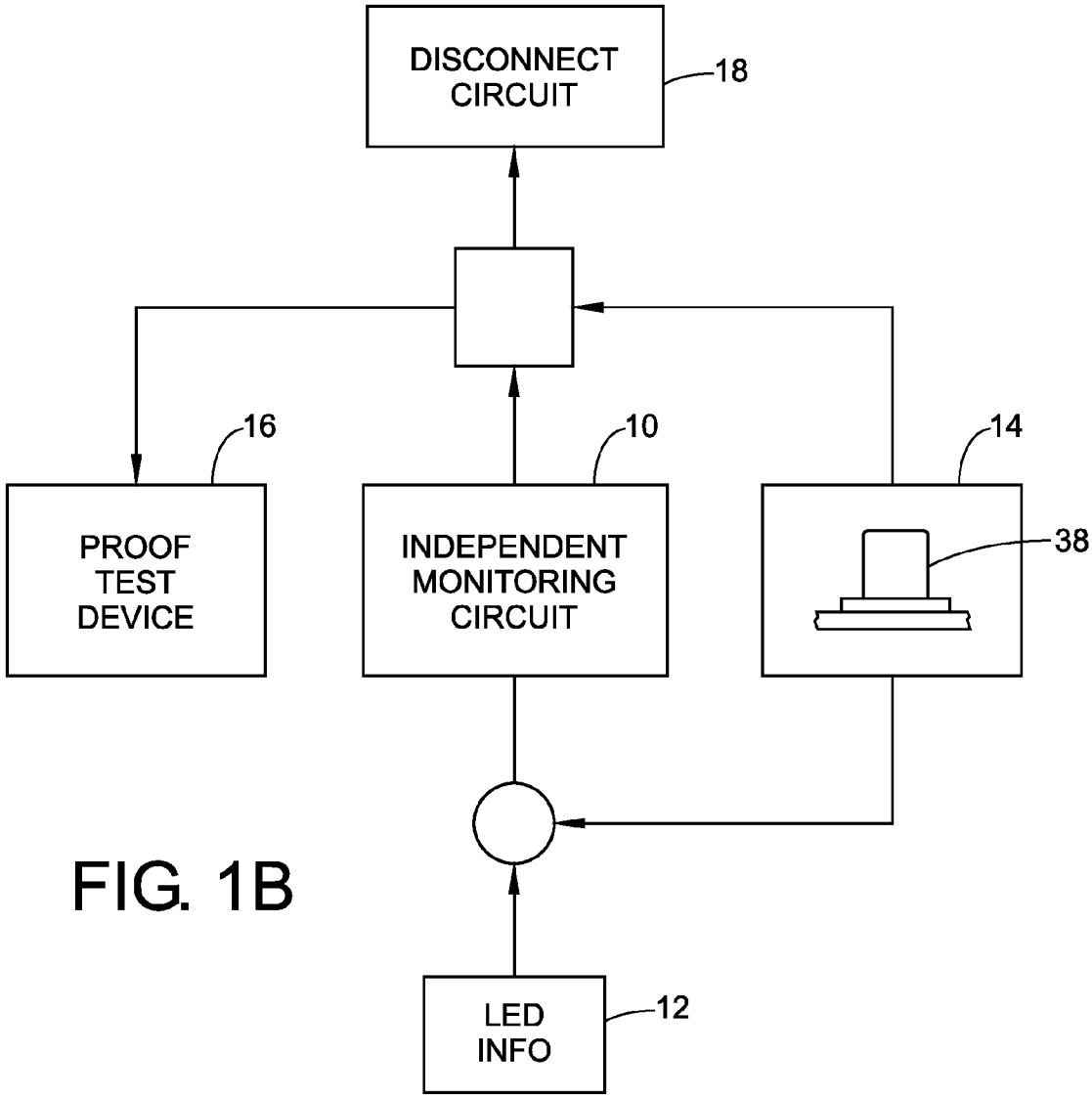
Figure 1C:
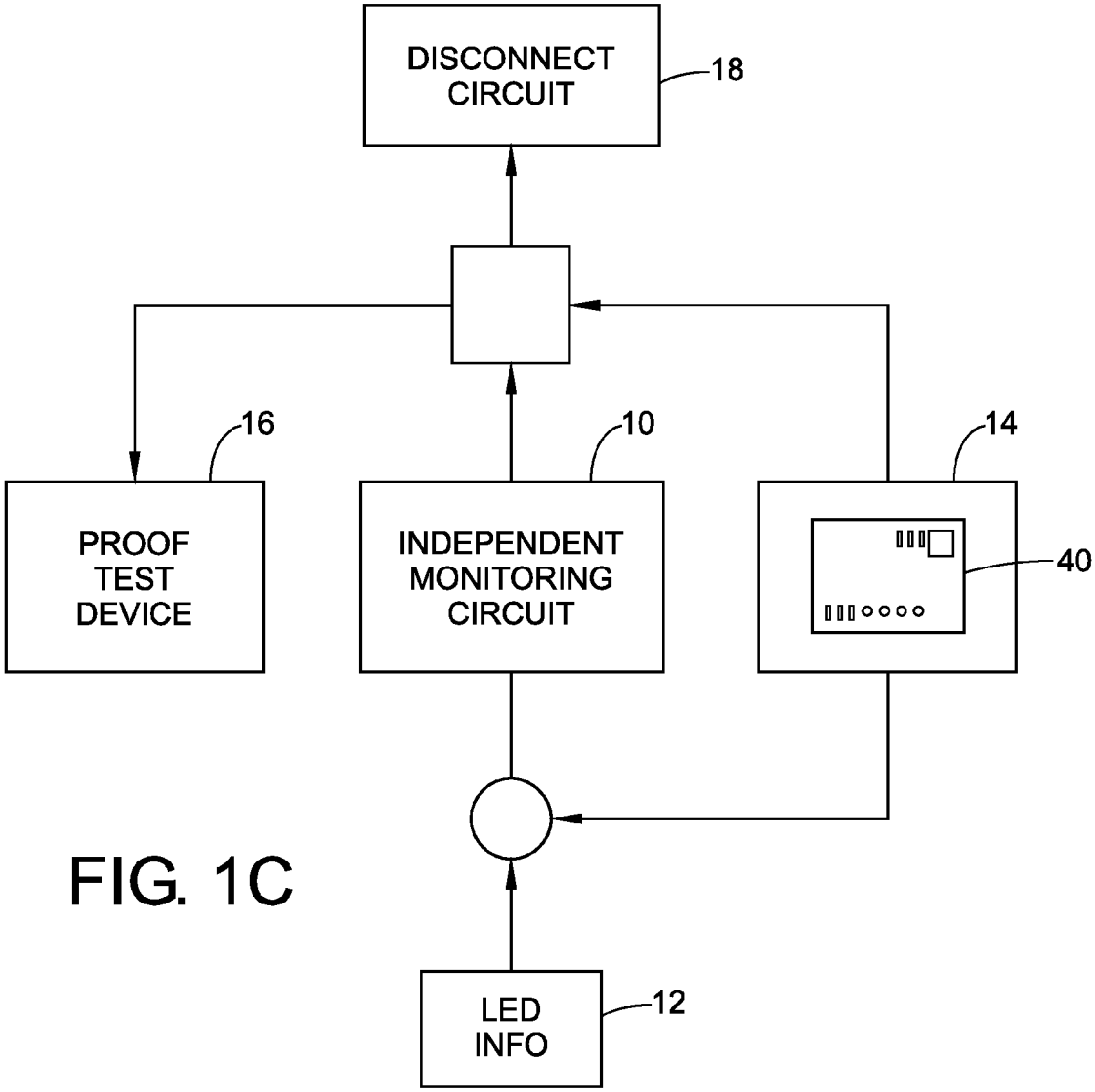
Figure 1D:
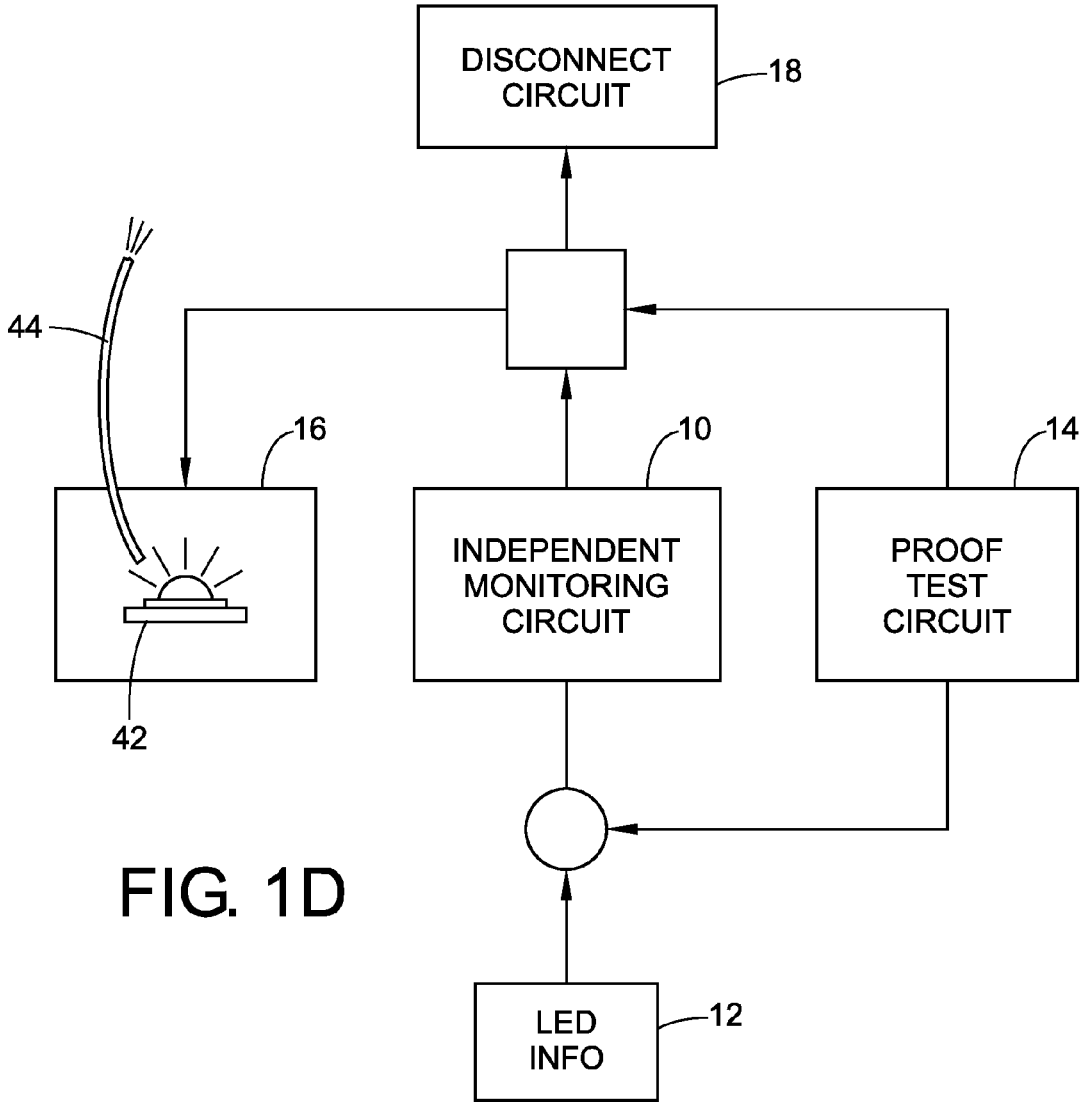
Figure 1E:
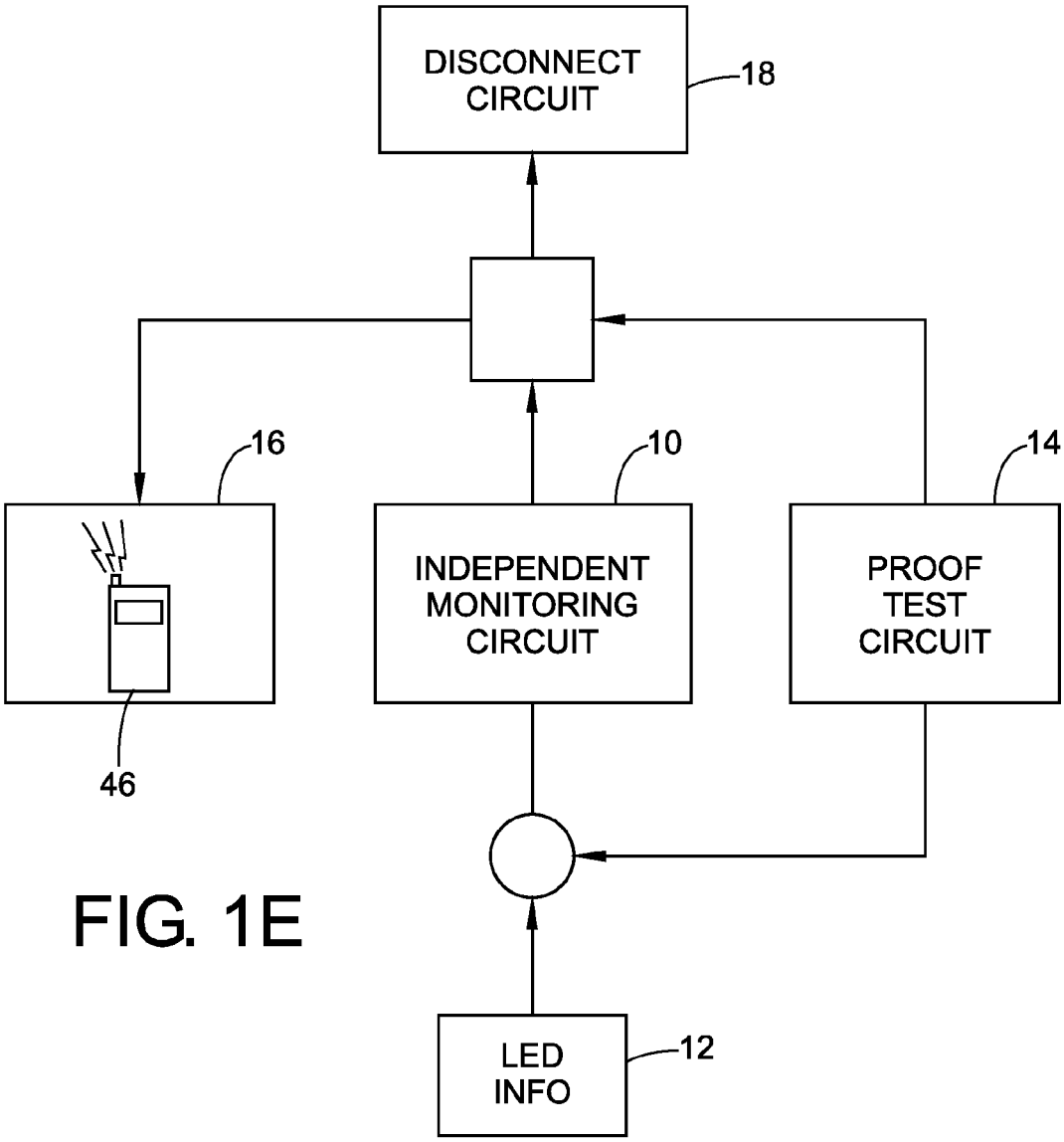
Figure 1F:
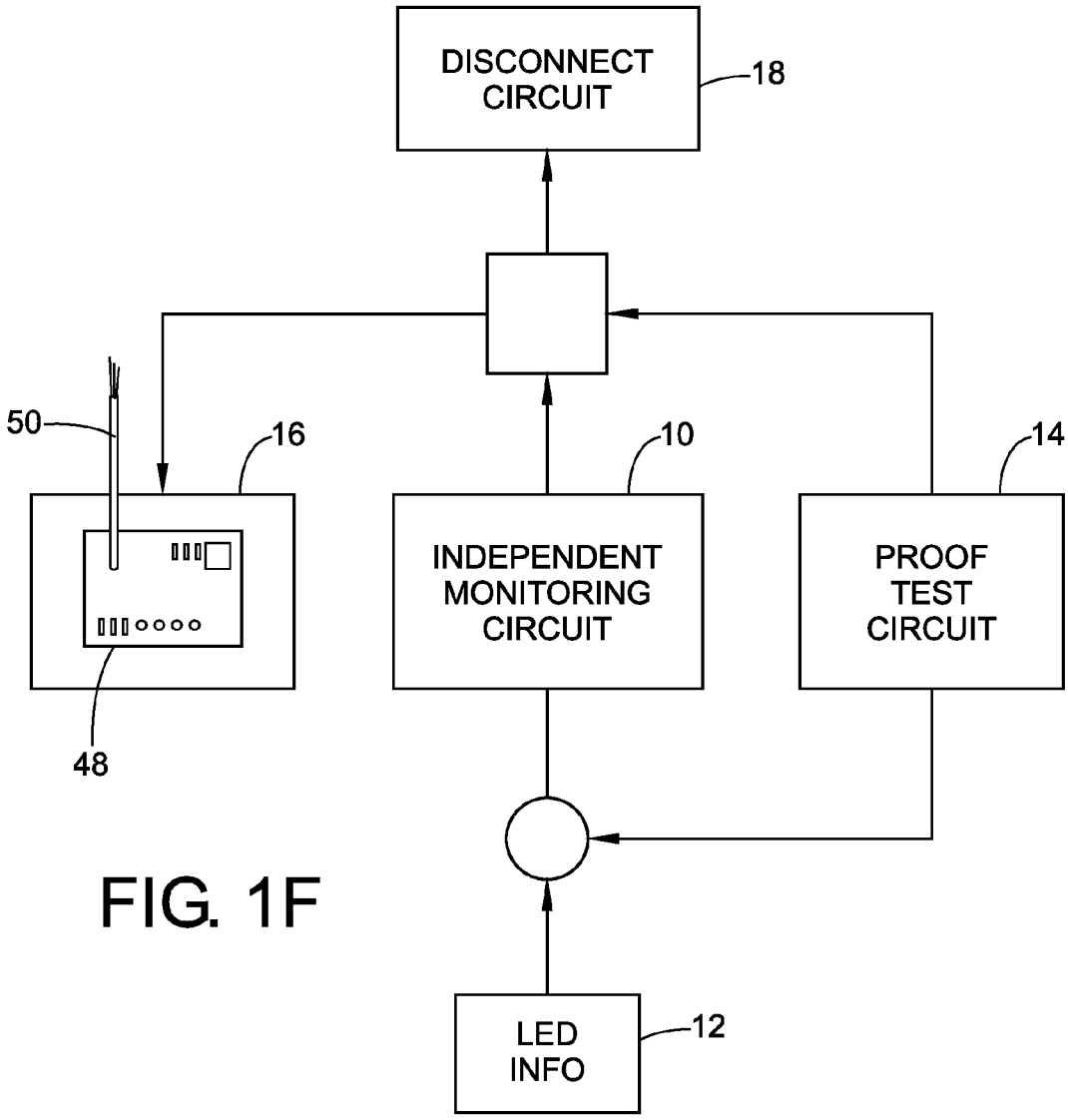

Referring now to the drawings wherein the showings are for purposes of illustrating the exemplary embodiments only and not for purposes of limiting the claimed subject matter, FIG. 1 provides a block diagram of one embodiment of the invention. As shown generally, FIG. 1 includes an independent monitoring circuit 10, which receives LED information 12, a proof test circuit (PTC) 14, a proof test device (PTD) 16, and a disconnect circuit 18.

The LED information 12 represents a measurement of the current flowing into the LEDs. This may be accomplished, for example, by having at least one resistor in series with the LEDs and measuring the voltage drop on the resistor(s). It is assumed that this current is generating light. Thus, the independent monitoring circuit 10 looks to the state of the LED traffic signal. If the independent monitoring circuit 10 detects that there is no light (i.e., the current is zero or below some threshold value), then it disconnects a fuse in series with the main circuit. The traffic controller detects that a lamp is off and that the traffic signal will need to be repaired or replaced.

The PTC 14 and the PTD 16 are generally embedded into the traffic signal. With reference to FIGS. 1A-1F, the PTC 14 may comprise one of several embodiments, including, but not limited to: (a) a push button 30 with two contacts 32, with the PTC 16 embedded as a light-emitting device 34, and, as an option, a current limiting resistor 36; (b) any type of mechanical button 38 associated with an electronic circuit; or (c) an electronic circuit 40 that self-generates the test command for the independent monitoring circuit 10 at specified intervals and for a limited period of time.

Likewise, the PTD 16 may comprise one of several embodiments, including, but not limited to: (a) a light-emitting device of any type, e.g., a light emitting diode 42 that generates light when current passes through it (the PTD 16 can use a light conduit device 44 to bring the light spot at a desired location); (b) a wireless transmission signal emitter 46 that establishes a wireless communication path, or an infrared signal emitter, to transfer the independent monitoring circuit state information; or (c) an electronic circuit 48 that uses the traffic signal power cable 50 to transmit the independent monitoring circuit state information.

The disconnect circuit 18 generally comprises a power transistor (MOSFET). Thus, it is possible to drive the power transistor to create a high short circuit current and blow the fuse in series with the main circuit. However, during the proof test, the disconnect circuit 18 is disabled.

In operation, from time to time, the PTC 14 simulates a faulty traffic signal state (i.e., current equals zero or is below some threshold value) to activate the independent monitoring circuit 10 without switching the traffic signal into a high impedance state. That is, the independent monitoring circuit 10 should not disconnect the fuse in series with the main circuit. If the independent monitoring circuit 10 works properly, the PTD 16 is energized, and it communicates externally the current state of the independent monitoring circuit 10. The failure to communicate shall be considered a traffic signal failure, and the traffic controller or the maintenance technician is thus notified and the traffic signal shall be immediately replaced.

The simulation test does not interfere with the overall functionality of the traffic signal. There is no need to open the traffic signal in order to diagnose the independent monitoring circuit 10. The test can be done by periodical manual proof testing or on-line testing. The time interval between manual proof tests (or on-line tests) shall be determined such that the second failure probability is less than $10^{-5}$ per year.

Figure 2:
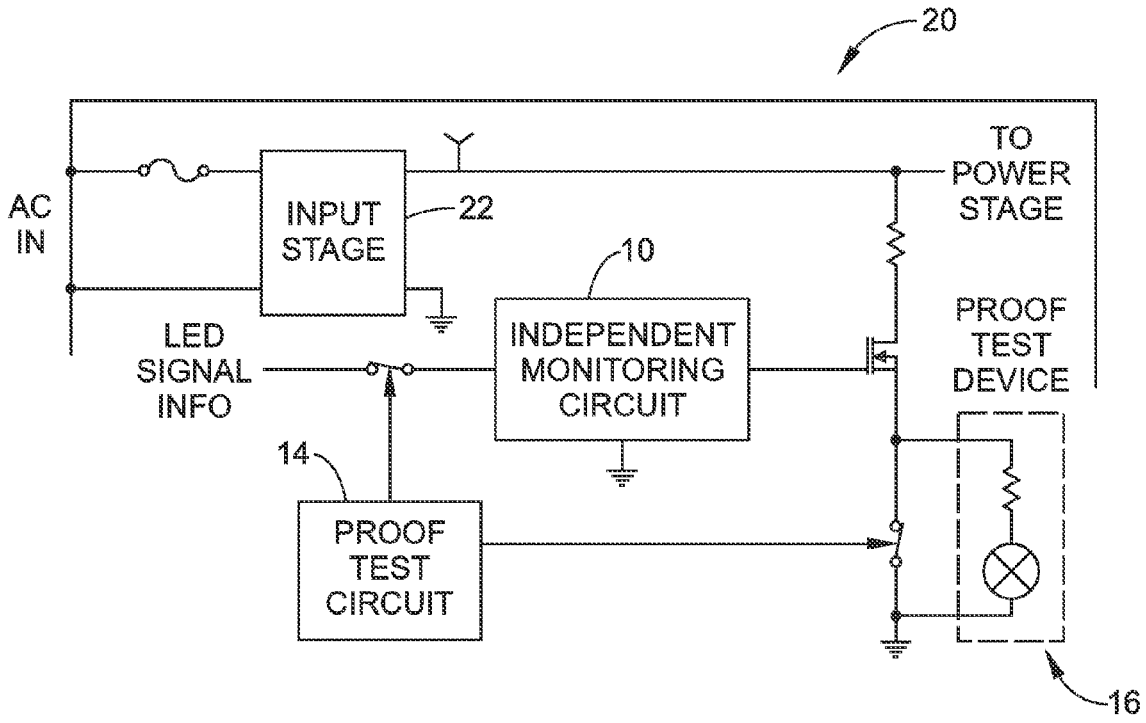
FIG. 2 is an electrical schematic of one embodiment of LED proof test circuitry.

FIG. 2, which shows electronic circuitry within the lamp enclosure 20, represents one possible embodiment of the invention. It is to be understood, of course, that other embodiments are contemplated.

As shown in FIG. 2, the input stage 22 is connected to the mains line. Resistor R1 limits the short circuit current to protect the transistor Q. To start the proof test, contacts C1 and C2 (e.g., transistors) are opened. Because contact C1 is opened, the independent monitoring circuit 10 detects a missing LED signal and energizes the transistor Q. Since contact C2 is opened, the current is forced to go through resistor R2 and LED LD, which are in series. (Note that in this example resistor R2 has high impedance as compared to resistor R1, which is simply there to limit the short circuit current to protect transistor Q.) Thus, current passes through the LED LD and light is emitted. The LED LD is now visible from outside the traffic signal and is thus analyzed.

The LED light signal interpretation is as follows:

1. If there is no light present, then the independent monitoring circuit 10 or the PTC 14 is defective. In that case, the traffic light is replaced and the defective one is repaired.

2. If there is light during the test only, then everything is correct. In that case, no action is taken.

3. If there is permanent light, then the PTC 14 is defective. As in the first case, the traffic light is replaced and the defective one is repaired.

To end the test, contacts C1 and C2 are closed. It is to be understood that the test duration and the repetition rate (duty cycle) is variable and depends on the traffic signal application.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. An apparatus for testing LED traffic signal components, the apparatus comprising:

an independent monitoring circuit that is configured to continuously receive LED information and disconnect an LED signal when the independent monitoring circuit detects that the LED signal is not generating light;

a proof test circuit embedded within the traffic signal and in communication with the independent monitoring circuit, wherein the proof test circuit is configured to simulate a faulty traffic signal state to activate the independent monitoring circuit without switching the traffic signal into a high impedance state;

a proof test device embedded within the traffic signal and in communication with the independent monitoring circuit, wherein the proof test device is configured to communicate externally a current state of the independent monitoring circuit.

2. The apparatus of claim 1, wherein the proof test circuit is configured to be activated via a push button with two contacts and a current limiting resistor.

3. The apparatus of claim 1, wherein the proof test circuit is configured to be activated via a mechanical button associated with an electronic circuit.

4. The apparatus of claim 1, wherein the proof test circuit comprises an electronic circuit that self-generates a test command for the independent monitoring circuit at specified intervals and for a limited period of time.

5. The apparatus of claim 1, wherein the proof test device comprises a light-emitting device.

6. The apparatus of claim 5, wherein the light-emitting device comprises a light emitting diode that generates light when current passes through it and a light conduit device for bringing the light spot at a desired location.

7. The apparatus of claim 1, wherein the proof test device comprises a wireless transmission signal emitter for establishing a wireless communication path to transfer independent monitoring circuit state information.

8. The apparatus of claim 1, wherein the proof test device comprises an infrared signal emitter to transfer independent monitoring circuit state information.

9. The apparatus of claim 1, wherein the proof test device comprises an electronic circuit that uses a traffic signal power cable to transmit independent monitoring circuit state information.

10. A method of testing an independent monitoring circuit in a LED traffic signal, the method comprising:

via a proof test circuit embedded in the traffic signal, simulating a faulty traffic signal state;

activating the independent monitoring circuit without switching the traffic signal into a high impedance state;

energizing a proof test device embedded in the traffic signal; and via the proof test device, communicating externally the current state of the independent monitoring circuit.

11. The method of claim 10, further comprising: detecting the faulty traffic signal state when the current equals zero or is below some threshold value.

12. The method of claim 10, activating the proof test circuit via a push button with two contacts and a current limiting resistor.

13. The method of claim 10, activating the proof test circuit via a mechanical button associated with an electronic circuit.

14. The method of claim 10, activating the proof test circuit via an electronic circuit that self-generates a test command for the independent monitoring circuit at specified intervals and for a limited period of time.

15. The method of 10, activating the proof test device via a light-emitting device.

16. The method of claim 15, further comprising a light emitting diode that generates light when current passes through it and a light conduit device for bringing the light spot at a desired location.

17. The method of claim 10, further comprising: activating the proof test device via a wireless transmission signal emitter that establishes a wireless communication path to transfer independent monitoring circuit state information.

18. The method of claim 10, further comprising: activating the proof test device via an infrared signal emitter to transfer independent monitoring circuit state information.

19. The method of claim 10, further comprising: activating the proof test device via an electronic circuit that uses a traffic signal power cable to transmit independent monitoring circuit state information.

* * * * *